US008581516B2

(12) United States Patent
Lai

(10) Patent No.: US 8,581,516 B2
(45) Date of Patent: Nov. 12, 2013

(54) POWER PROCESSING APPARATUS AND METHOD OF RELEASING THE RESIDUAL POWER THEREOF

(75) Inventor: Wen-Shang Lai, Changhua County (TW)

(73) Assignee: HEP Tech Co., Ltd., Taichung (TW)

( * ) Notice: Subject to any disclaimer, the term of this patent is extended or adjusted under 35 U.S.C. 154(b) by 150 days.

(21) Appl. No.: 13/315,795

(22) Filed: Dec. 9, 2011

(65) Prior Publication Data

US 2013/0147392 A1 Jun. 13, 2013

(51) Int. Cl.
*H05B 37/02* (2006.01)

(52) U.S. Cl.
USPC ..... 315/297

(58) Field of Classification Search
None
See application file for complete search history.

*Primary Examiner* — Crystal L Hammond
(74) *Attorney, Agent, or Firm* — Apex Juris, pllc; Tracy M. Heims

(57) ABSTRACT

A power processing apparatus includes an input port, an output port, a power transforming module, and a power releasing module. The power transforming module is between the input port and the output port to transform power into predetermined voltage or current. The power transforming module has a capacitor unit connected to LEDs in parallel. The power releasing module has a switch unit to disconnect the resistor unit and the capacitor unit when the power transforming module receives the power, and to connect the resistor unit to the capacitor unit when the power transforming module does not receive the power. Therefore, it may release the residual power to make the LED off in a short time when one turns off the power.

24 Claims, 9 Drawing Sheets

POWER PROCESSING APPARATUS AND METHOD OF RELEASING THE RESIDUAL POWER THEREOF

BACKGROUND OF THE INVENTION

1. Field of the Invention

The present invention relates generally to a power supply, and more particularly to a power processing apparatus to supply light-emitting diode (LED) power and a method of releasing residual power.

2. Description of the Related Art

With advancement in technology, light-emitting diode (LED) is more and more popular in the modern market. LED has many advantages, including small size, short response time, long life, low decrement, strong surface, anti-vibration, emitting full-color light (including invisible light), low power loss, low radiant heat, and easy to manufacture. Therefore, more and more light sources use LED to replace light bubble or tube.

FIG. 1 shows a conventional power processing apparatus 70, including an input port 71, an output port 72, and a power transforming module 73. A power source 110 is connected to the input port 71 to provide AC power, and LEDs 80 are connected to the output port 72. The power transforming module 73 is between the input port 71 and the output port 72, including a capacitor unit 731, a rectifier-filter unit 732, and a DC/DC converter 733. The capacitor unit 731 and the LEDs 80 are in parallel connection. The rectifier-filter unit 732 is between the input port 71 and the DC/DC converter 733 to transform the AC power into more stable DC power. The DC/DC converter 733 receives the DC power from the rectifier-filter unit 732, and change to a predetermined voltage or current level DC power, and then the DC power is transmitted to the capacitor unit 731 and the LEDs 80 through the output port 72 to light the LEDs 80.

As shown in FIG. 2, the LEDs will keep lighting for a while after someone turns off the power switch SW because of the capacitor unit 731. Many consumers may think the electronic device is malfunctioned or has some problems. Therefore, the conventional power processing apparatus 70 still has to be improved.

SUMMARY OF THE INVENTION

The primary objective of the present invention is to provide a power processing apparatus and a method of releasing the residual power, which may turn the LED off soon after one cuts the power off.

According to the objective of the present invention, the present invention provides a power processing apparatus for transforming power from a power source to light at least a light emitting diode, which includes an input port, an output port, a power transforming module, and a power releasing module. The input port electrically connects the power source, and the output port electrically connects the light emitting diode. The power transforming module is between the input port and the output port to transform the power from the power source into predetermined voltage or current. The power transforming module has a capacitor unit connected to the light emitting diode in parallel. The power releasing module has a resistor unit. The power releasing module is electrically connected to power transforming module that the resistor unit is disconnected to the capacitor unit when the power transforming module receives the power from the power source, and the resistor unit is connected to the capacitor unit in parallel when the power transforming module does not receive the power from the power source to release the power stored in the capacitor unit.

The present invention further provides a method of releasing residual power of the power processing apparatus, which includes the following steps:

Detect whether the power transforming module receives the power from the power source;

Disconnect the resistor unit and the capacitor unit when the power transforming module receives the power; and Connect the resistor unit and the capacitor unit to release power stored in the capacitor unit when the power transforming module does not receive the power The present invention further provides another a method of releasing residual power of the power processing apparatus, which includes the following steps:

Detect whether the power transforming module receives the power from the power source; and Release over 50% power stored in the capacitor unit in two seconds when the power transforming module does not receive the power from the power source.

Therefore, the present invention may release the residual power to make the LED off in a short time when one turns off the power.

DETAILED DESCRIPTION OF THE INVENTION

Figure 1:
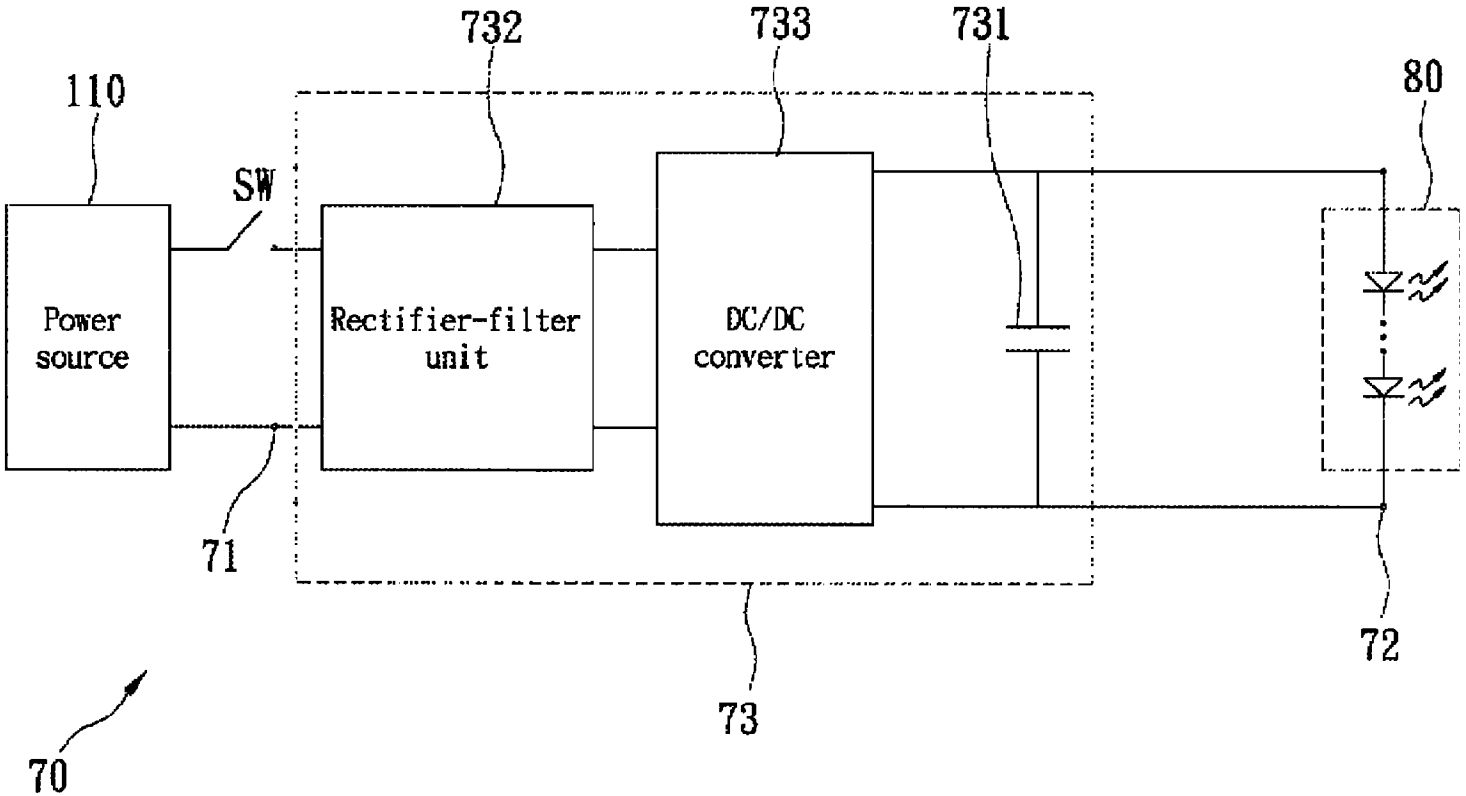
FIG. 1 (PRIOR ART)
FIG. 1 is a block diagram of the conventional power processing apparatus.
Figure 2:
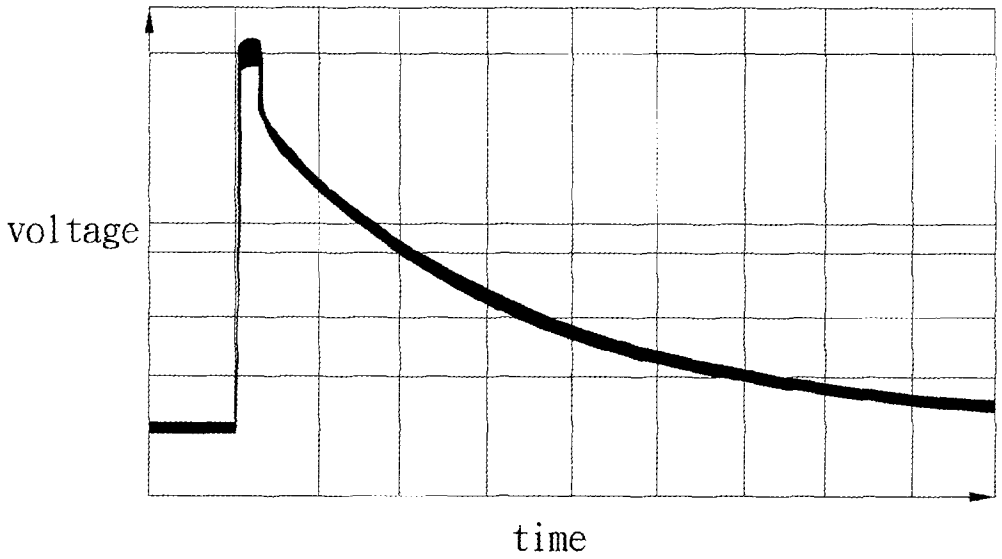
FIG. 2 (PRIOR ART)
FIG. 2 is a waveform diagram of the power of the LED received from the conventional power processing apparatus after the power switch is turned off.
Figure 3:
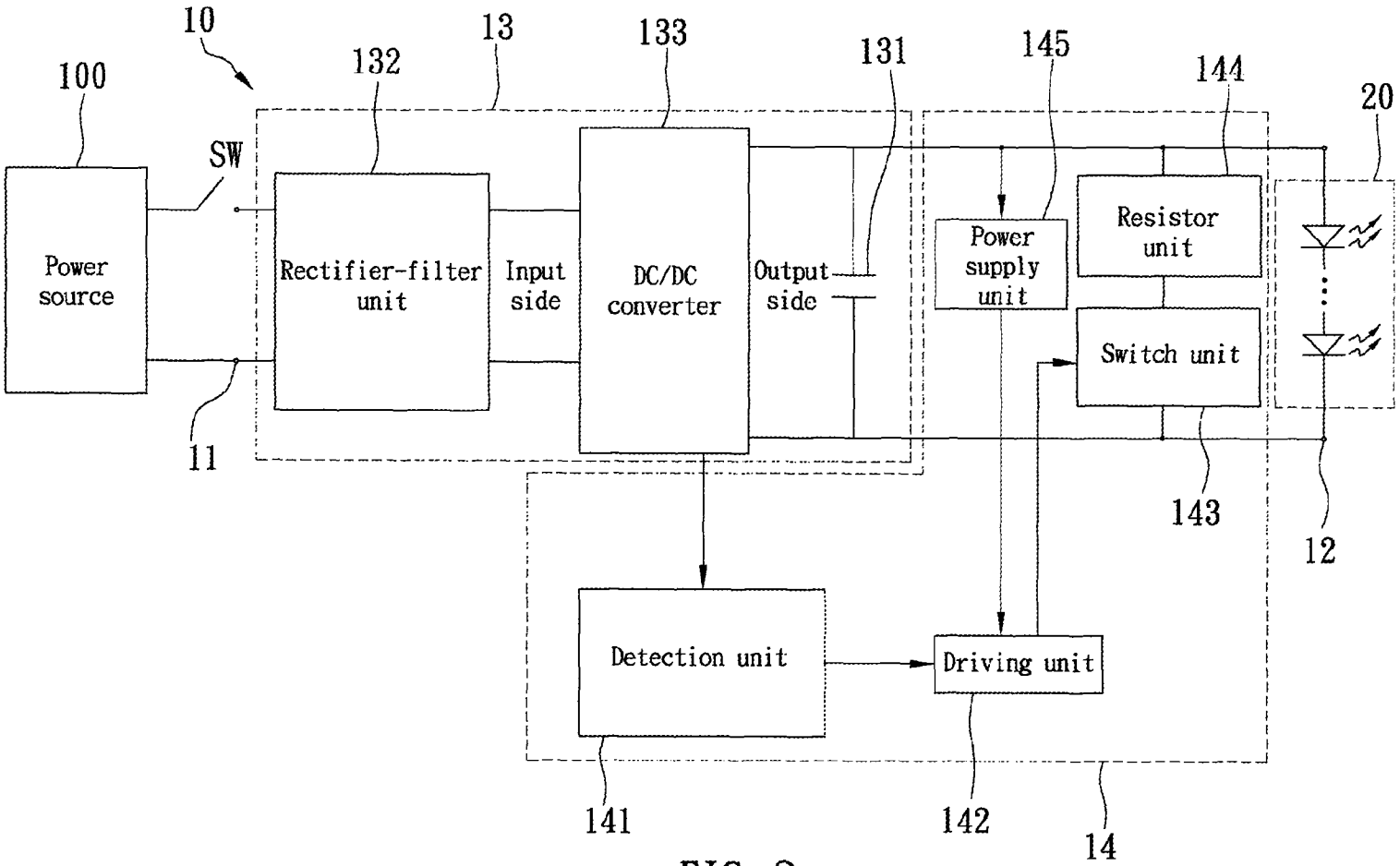
FIG. 3 is a block diagram of a first preferred embodiment of the present invention.

FIG. 3 shows a power processing apparatus 10 of the first preferred embodiment of the present invention, which transforms power from a power source 100 to light a plurality of LEDs 20. The power may be the AC power from the power station or the AC/DC power from other power systems, such as wind power, solar power, geothermal power etc. The power processing apparatus 10 of the present invention includes an input port 11, an output port 12, a power transforming module 13, and a power releasing module 14.

The input port 11 is connected to the power source 100, and the LEDs 20 are connected to the output port 20.

The power transforming module 13 is between the input port 11 and the output port 20, including a capacitor unit 131, a rectifier-filter unit 132, a DC/DC converter 133. The capacitor unit 131 is connected to the LEDs 20 in parallel. The rectifier-filter unit 132 is between the input port 11 and the DC/DC converter 133 to transform the power from the power source 100 into stable DC power. The DC/DC converter 133 has an input side and an output side, wherein the input side is electrically connected to the rectifier-filter unit 132, and the output side is connected to the capacitor unit 131. The DC/DC converter 133 receives the DC power from the rectifier-filter unit 132, and change to a predetermined voltage or current level DC power to the capacitor unit 131. In the present invention, the DC/DC converter 133 is a flyback converter.

The power releasing module 14 respectively includes a detection unit 141, a driving unit 142, a switch unit 143, and a resistor unit 144 in serial connection. The output side of the DC/DC converter 133 is electrically connected to the detection unit 141. The power releasing module 14 further includes a power supply unit 145 electrically connected to the driving unit 142 to supply the driving unit 142 power and to turn off the LEDs soon after one cuts off the power by the following method. An electricity releasing method is executed automatically after the power source 100 is connected to the power transforming module 13, and the method includes the following steps:

Detect whether the power transforming module 13 has received the power. In the present invention, the detection unit 141 detects the power at the output side of the DC/DC converter 133. If power is detected, it considers that the power transforming module 13 has received the power from the power source 100.

When one turns on the power switch SW and the power is supplied to the power transforming module 13 and the detection unit 141 detects the power, the detection unit 141 generates a disable signal to counteract the power supplied to the driving unit 142. At this time, the driving unit 142 stops working to activate the switch unit 143 to cut off the connection between the resistor unit 144 and the capacitor unit 131. Therefore, the resistor unit 144 is disconnected to the capacitor unit 131 when one turns on the power switch SW to light the LEDs 20 that the resistor unit 144 will not cause the power loss to reduce the power consumption.

Figure 4:
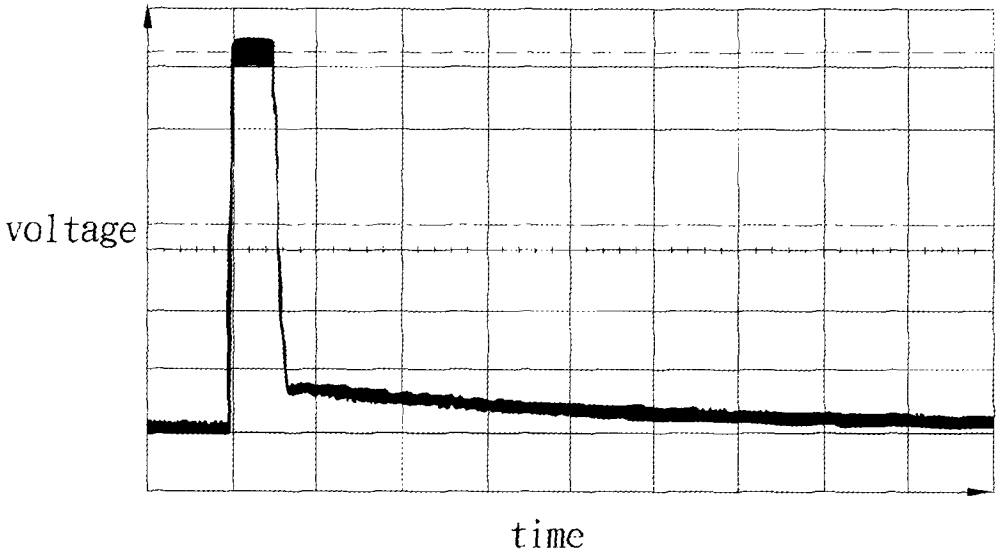
FIG. 4 is a waveform diagram of the power of the LED received from the first preferred embodiment of the present invention after the power switch is turned off.

When the power switch SW is turned off to cut of the power and the detection unit 141 does not detect the power, the detection unit 141 will not generate the disable signal that the driving unit 142 is working by the power from the power supply unit 145 to activate the switch unit 143 to connect the resistor unit 144 and the capacitor unit 131 in parallel. Therefore, over 50% power stored in the capacitor unit 131 will be consumed by the resistor unit 144 in two seconds, as shown in FIG. 4, that may make the LED unit 20 completely off in two seconds. In addition, the power supply unit 145 only supplies the driving unit 142 power for a predetermined time after the power switch SW is turned off to avoid the extra power loss when the power switch SW is turned on again and the resistor unit 144 is still connected to the capacitor unit 131.

Figure 5:
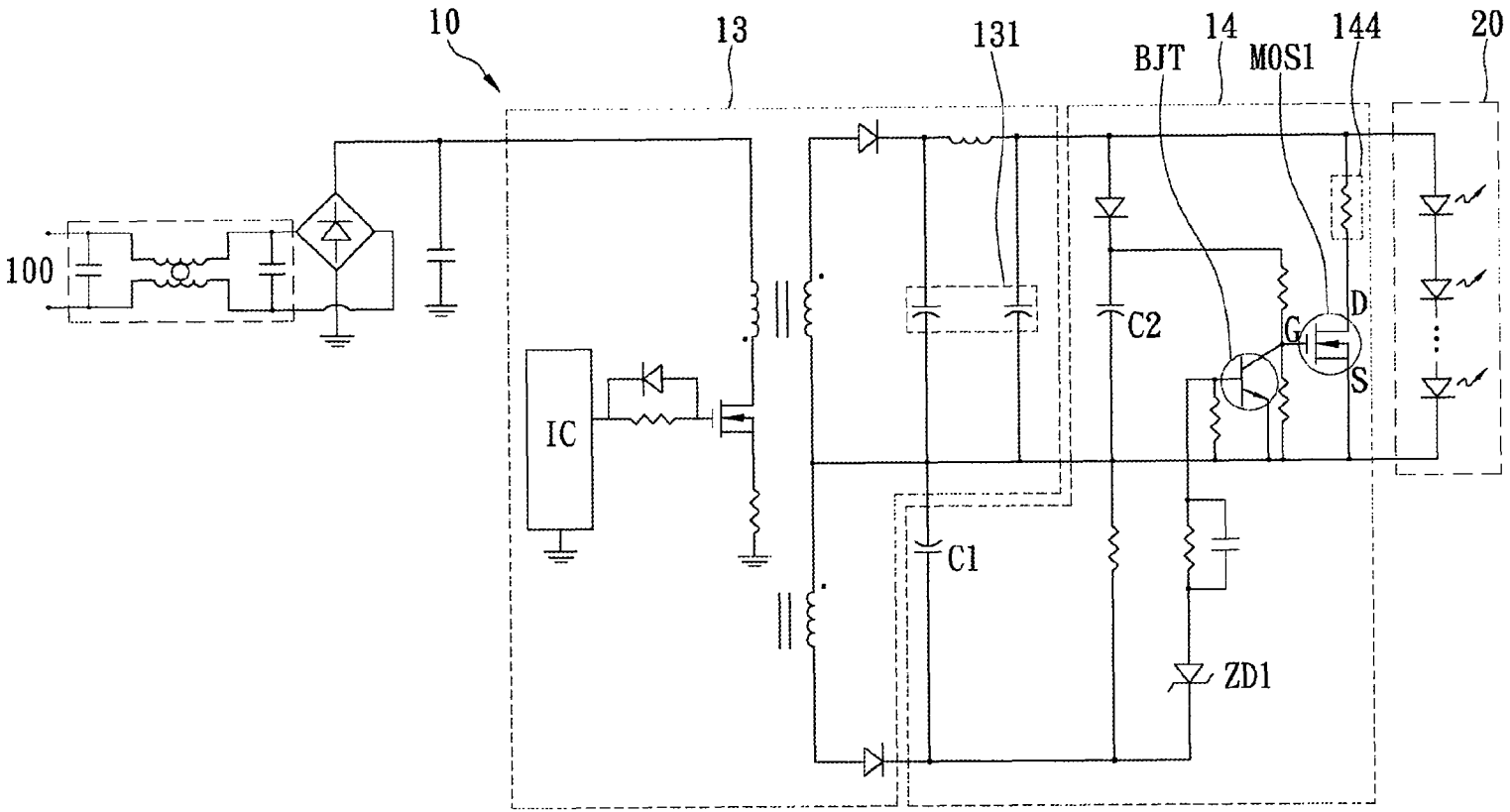
FIG. 5 is a circuit of the first preferred embodiment of the present invention.

FIG. 5 shows a detail circuit of the power processing apparatus 10 of the first preferred embodiment of the present invention. When power switch SW is turned on, the capacitors C1 and C2 are charged to switch a transistor BJT to an active region, and then the transistor BJT will disconnect a source S and a drain D of a MOSFET (Metal-Oxide-Semiconductor Field-Effect Transistor) MOS1 that may disconnect the resistor unit 144 and the capacitor unit 131. After the power switch SW is turned off, the capacitor C1 starts to release the power stored therein, and when the potential of the capacitor C1 is lower than a predetermined voltage, it will idle a zener diode ZD1 to switch the transistor BJT to a cutoff region, at the same time, the capacitor C2 supplies power to the gate G of the MOSFET MOS1 to connect the resistor unit 144 and the capacitor unit 131 in parallel that will make the LEDs 20 off in a short time. After a time when the power in the capacitor C2 less to enable the MOS1 Gate, the source S and the drain D of the MOSFET MOS1 are disconnected to disconnect the resistor unit 144 and the capacitor unit 13 again.

Figure 6:
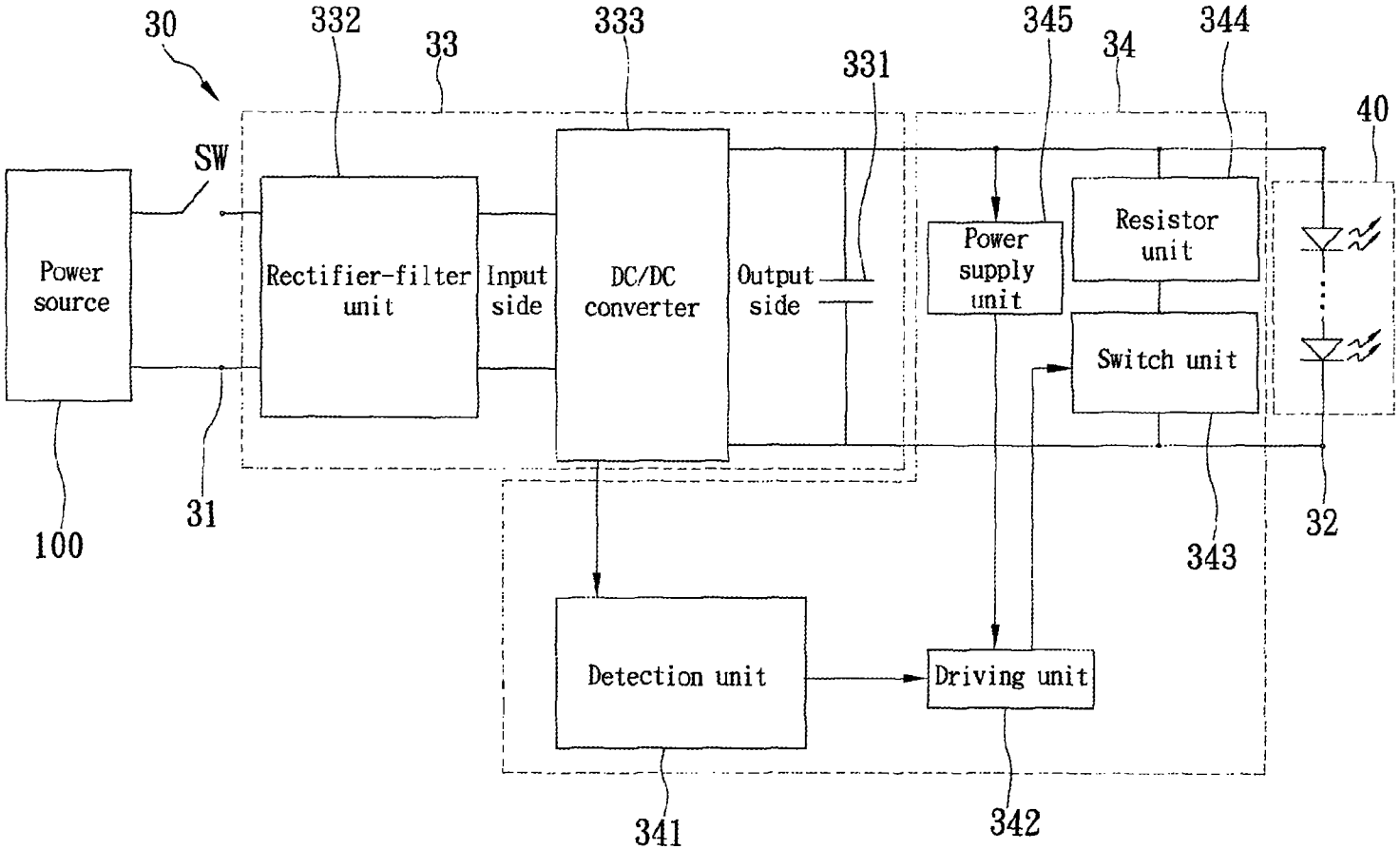
FIG. 6 is a block diagram of a second preferred embodiment of the present invention.

As shown in FIG. 6, a power processing apparatus 30 of the second preferred embodiment of the present invention includes an input port 31, an output port 32, a power transforming module 33, and a power releasing module 34. The input port 31 and the output port 32 are the same as the first preferred embodiment. The power transforming module 33 includes a capacitor unit 331, a rectifier-filter unit 332, and a DC/DC converter 333. The power releasing module 34 includes a detection unit 341, a driving unit 342, a switch unit 343, a resistor unit 344, and a power supply unit 345. The different part of the second preferred embodiment is that the detection unit 341 is electrically connected to an input side of the DC/DC converter 333 to detect the power. The rest features and functions are the same as the first preferred embodiment.

Figure 7:
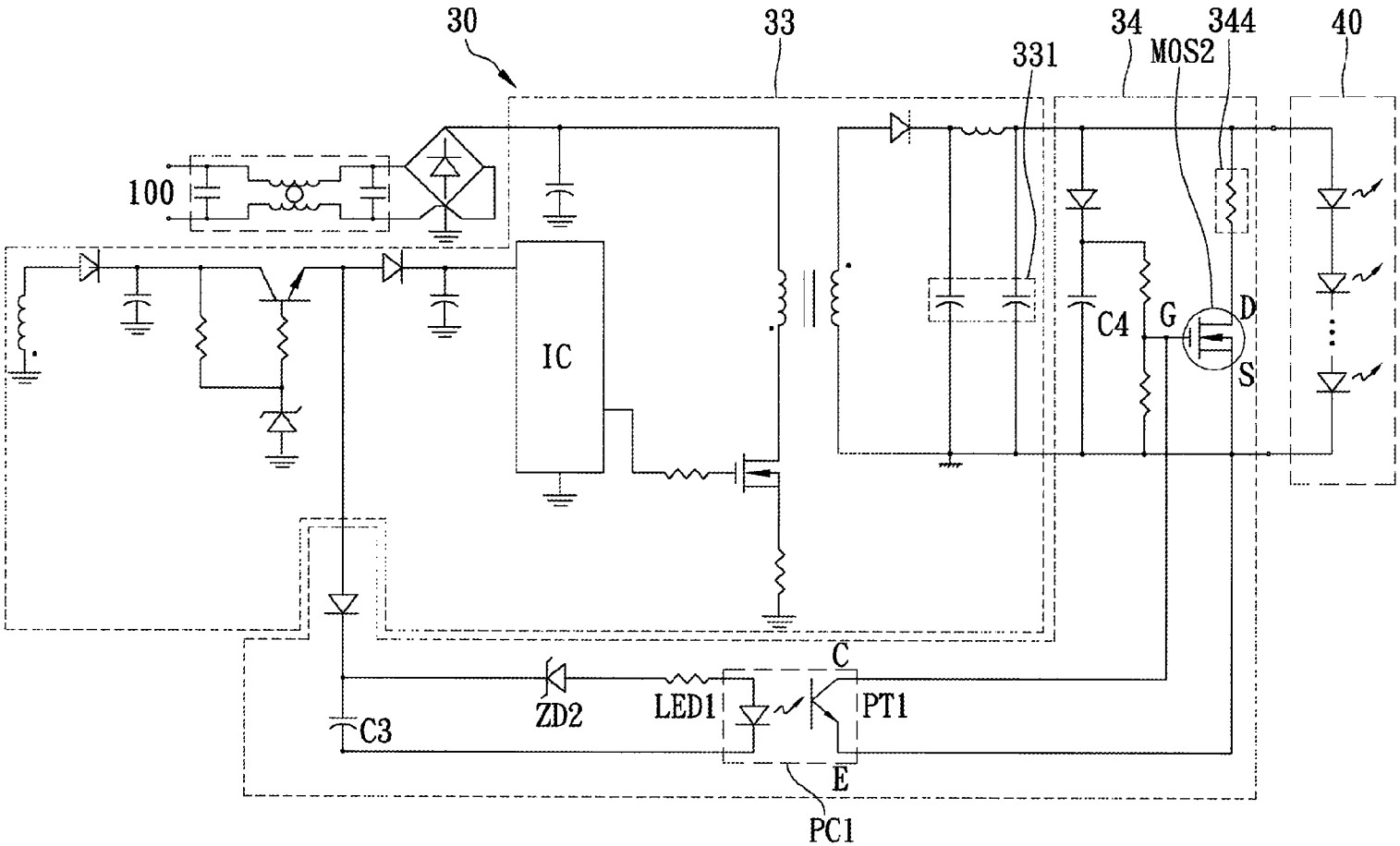
FIG. 7 is a circuit of the second preferred embodiment of the present invention.

FIG. 7 shows a detail circuit of the power processing apparatus 30 of the second preferred embodiment. When the power switch SW is turned on, a capacitor C3 will be charged to light a LED LED1 in a photo coupler PC1 to connect a collector C and an emitter E of a photo transistor PT1. It will disconnect a source S and a drain D of a MOSFET to disconnect the resistor unit 344 and the capacitor unit 331. When the power switch SW is turned off, the capacitor C3 starts to release the power stored therein. When the potential of the capacitor C3 is lower than a predetermined voltage, it will idle a zener diode ZD2 and turn off the LED LED1 of the photo coupler PC1. It will disconnect the collector C and the emitter E of the photo transistor PT1. At the same time, the capacitor C4 provides power to a gate G of a MOSFET MOS2 to connect the source S and the drain D thereof. It will connect the resistor unit 344 and the capacitor unit 331. The capacitor unit 331 releases power stored therein to be consumed by the resistor unit 344 that may make the LEDs 40 off in a short time. After the power of the capacitor C4 is out, it will disconnect the source S and the drain D of the MOSFET MOS2 that the capacitor unit 331 is disconnected to the resistor unit 344 again.

Figure 8:
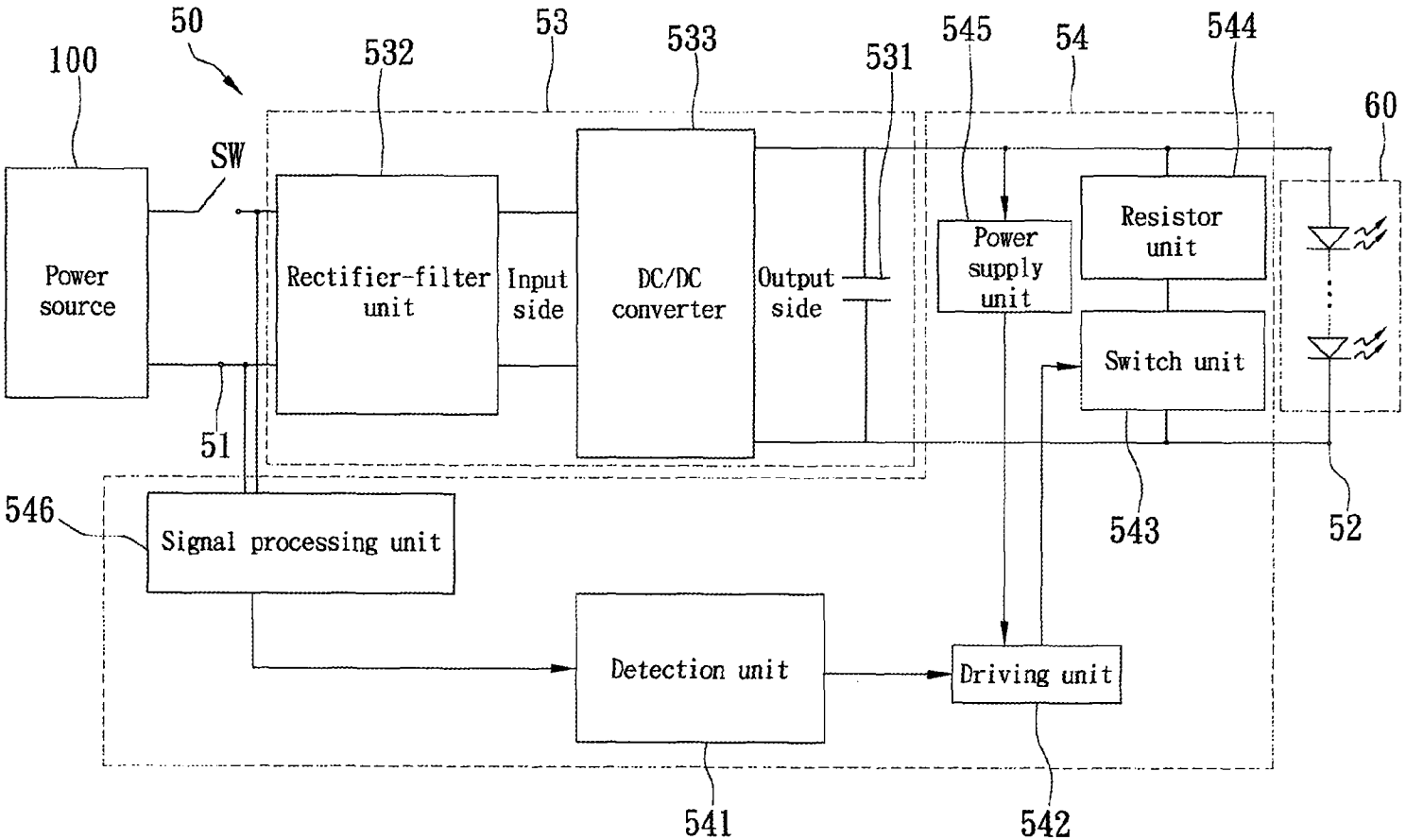
FIG. 8 is a block diagram of a third preferred embodiment of the present invention.

FIG. 8 shows a power processing apparatus 50 of the third preferred embodiment of the present invention, including an input port 51, an output port 52, a power transforming module 53, and a power releasing module 54. The input port 51 and the output port 52 are the same as the first preferred embodiment. The power transforming module 53 includes a capacitor unit 531, a rectifier-filter unit 532, a DC/DC converter 533. The power releasing module 54 includes a detection unit 541, a driving unit 542, a switch unit 543, a resistor unit 544, and a power supply unit 545. The different part of the third preferred embodiment is that the power releasing module 54 further includes a signal processing unit 546, which is electrically connected to a line between the input port 51 and the DC/DC converter 533 to receive the power from the power source 100, transform the power to have a predetermined voltage, and send it to the detection unit 541. In the present embodiment, the signal processing unit 546 is electrically connected to the line between the input port 51 and the rectifier-filter unit 532. The signal processing unit 546 provides a signal to the detection unit 541 to tell whether the power transforming module 53 has received the power from the power source 100. The way of turning off the LED 60 is the same as above. The main purpose of the signal processing unit 546 is to lower the voltage of the power transmitting to the detection unit 541 to avoid the detection unit 541 from damage by the high voltage.

Figure 9:
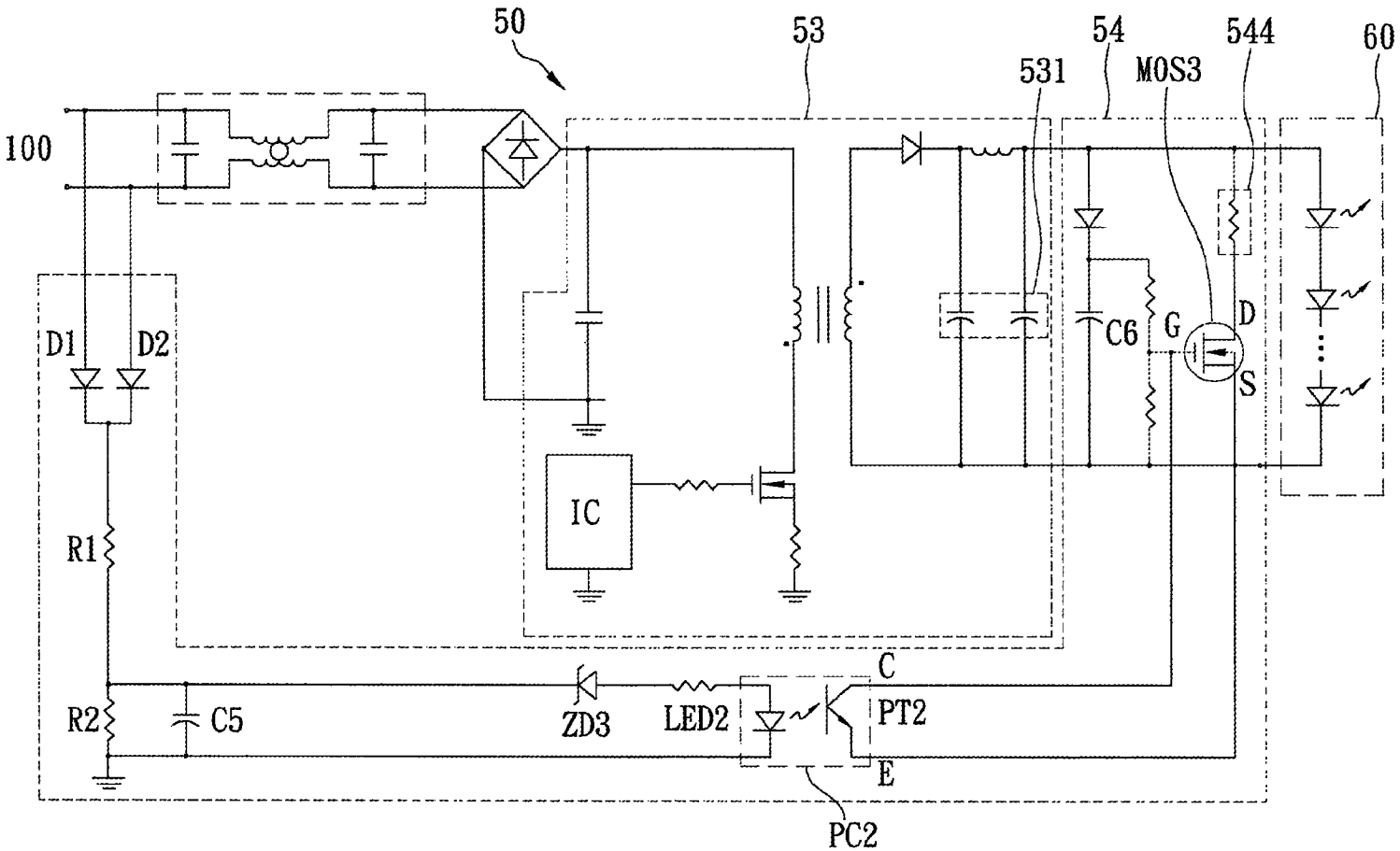
FIG. 9 is a circuit of the third preferred embodiment of the present invention.

FIG. 9 shows a detail circuit of the power processing apparatus 50 of the third preferred embodiment. When the power switch SW is turned on, the power source 100 provides power to the power transforming module 53, and then the power is rectified by a diode D1 or D2, or by diodes D1 and D2 of the signal processing unit 546, and the voltage thereof is reduced by resistor units R1 and R2 in series, and then is sent to the detection unit 541. A capacitor C5 is charged when the power switch SW is turned on to light the LED LED2 of the photo coupler PC2. It will connect a collector C and an emitter E of a photo transistor PT2 and disconnect a source S and a drain D of a MOSFET MOS3 to disconnect the capacitor 531 and the resistor unit 544. When the power switch SW is turned off, the capacitor C5 starts to release the power stored therein, and when the potential of the capacitor C5 is lower than a predetermined voltage, it will idle a zener diode ZD3 and turn off the LED LED2 of the photo coupler PC2 that will disconnect the collector C and the emitter E of the photo transistor PT2. At the same time, the capacitor C6 provides power to a gate G of the MOSFET MOS3 to connect the source S and the drain D thereof. The capacitor unit 531 releases power to be consumed by the resistor unit 544 that may make the LEDs 60 off in a short time. After the power of the capacitor C6 is out, it will disconnect the source S and the drain D of the MOSFET MOS3 that the capacitor unit 531 is disconnected to the resistor unit 544 again.

In conclusion, the power processing apparatus may make the LED off in a short time when one turns off the power that consumer may not misunderstand that the electronic device is malfunctioned.

It is known for a person skilled in the art that the DC/DC converter of the present invention may be an isolated converter, such as forward, push pull, and half-bridge converter, or a non-isolated converter, such as buck, boost, and buck-boost converter. When the DC/DC converter is the non-isolated converter, the power releasing module may be electrically connected to the line between the input side and the output side of the DC/DC converter. In addition, the rectifier-filter unit may simply have a capacitor filter or a half-bridge rectifier. The capacitor unit may have electrolytic capacitor or other types to store power. The switch unit may be an electronic switch, such as MOSFET switch, and BJT switch, or a mechanical switch, such as relay, and electromagnetic switch. The description above is a few preferred embodiments of the present invention and the equivalence of the present invention is still in the scope of claim construction of the present invention.

What is claimed is:

1. A power processing apparatus for transforming power from a power source to at least a light emitting diode, comprising:

an input port electrically connecting to the power source;

an output port electrically connecting to the light emitting diode;

a power transforming module between the input port and the output port to transform the power, wherein the power transforming module has a capacitor unit connected to the light emitting diode in parallel; and a power releasing module, which has a resistor unit, electrically connected to power transforming module, wherein the resistor unit is disconnected to the capacitor unit when the power transforming module receives the power from the power source, and the resistor unit is connected to the capacitor unit in parallel when the power transforming module does not receive the power from the power source.

2. The power processing apparatus as defined in claim 1, wherein the power transforming module includes a DC/DC converter having an input side and an output side to receive the power from the power source via the input side, transform the power, and transmit the power out via the output side, and wherein the power releasing module is electrically connected to the input side of the DC/DC converter.

3. The power processing apparatus as defined in claim 1, wherein the power transforming module includes a DC/DC converter having an input side and an output side to receive the power from the power source via the input side, transform the power, and transmit the power out via the output side, and wherein the power releasing module is electrically connected to the output side of the DC/DC converter.

4. The power processing apparatus as defined in claim 1, wherein the power transforming module includes a DC/DC converter having an input side and an output side to receive the power from the power source via the input side, transform the power, and transmit the power out via the output side, and wherein the power releasing module is electrically connected to a line between the input side and the output side of the DC/DC converter.

5. The power processing apparatus as defined in claim 1, wherein the power transforming module includes a rectifier-filter unit to receive the power from the power source and transform the power into a DC power, and a DC/DC converter having an input side and an output side to receive the DC power from rectifier-filter unit via the input side, transform the DC power, and transmit the DC power out via the output side, and wherein the power releasing module is electrically connected to a line between the input port and the DC/DC converter.

6. The power processing apparatus as defined in claim 5, wherein the power releasing module further includes a signal processing unit electrically connected to a line between the input port and the DC/DC converter, and a detection unit electrically connected to the signal processing unit to detect whether the power transforming module receives the power.

7. The power processing apparatus as defined in claim 1, wherein the power releasing module further includes a detection unit electrically connected to the power transforming module to detect whether the power transforming module receives the power, and a switch unit electrically connected to the resistor unit to disconnect the resistor unit and the capacitor unit when the detection unit detects the power, and connect the resistor unit and the capacitor unit in parallel when the detection unit does not detect the power.

8. The power processing apparatus as defined in claim 7, wherein the power releasing module further includes a driving unit between the detection unit and the switch unit to activate the switch unit to connect the resistor unit and the capacitor unit in parallel when the detection unit does not detect the power.

9. The power processing apparatus as defined in claim 8, wherein the power releasing module further includes a power supply unit electrically connected to the driving unit to supply the driving unit power to activate the switch unit to connect the resistor unit and the capacitor unit in parallel when the detection unit does not detect the power.

10. The power processing apparatus as defined in claim 9, wherein the power supply unit stops supplying the driving unit power after the power transforming module does not receive the power from the power source for a predetermined time.

11. A method of releasing residual power of a power processing apparatus, wherein the power processing apparatus includes an input port, an output port, a power transforming module having a capacitor unit, and a power releasing module having a resistor unit, the method comprising the steps of:

providing power to the power transforming module through the input port;

transforming the power by the power transforming module to charge the capacitor unit and light at least a light emitting diode through the output port;

detecting whether the power transforming module receives the power;

disconnecting the resistor unit and the capacitor unit when the power transforming module receives the power; and connecting the resistor unit and the capacitor unit to release power stored in the capacitor unit to the resistor unit when the power transforming module does not receive the power.

12. The method as defined in claim 11, further comprising the step of disconnecting the resistor unit and the capacitor unit when over 50% power stored in the capacitor unit is released in a predetermined time.

13. The method as defined in claim 11, further comprising the step of disconnecting the resistor unit and the capacitor unit when over 50% power stored in the capacitor unit is released.

14. The method as defined in claim 11, wherein the power is detected between the input port and the DC/DC converter.

15. The method as defined in claim 11, wherein the power transforming module includes a DC/DC converter having an input side and an output side to receive the power via the input side, transform the power, and transmit the power out via the output side, and the power is detected at the input side of the DC/DC converter.

16. The method as defined in claim 11, wherein the power transforming module includes a DC/DC converter having an input side and an output side to receive the power via the input side, transform the power, and transmit the power out via the output side, and the power is detected at the output side of the DC/DC converter.

17. The method as defined in claim 11, wherein the power transforming module includes a DC/DC converter having an input side and an output side to receive the power via the input side, transform the power, and transmit the power out via the output side, and the power is detected between the input side and the output side of the DC/DC converter.

18. A method of releasing residual power of a power processing apparatus, wherein the power processing apparatus includes an input port, an output port, a power transforming module having a capacitor unit, and a power releasing module having a resistor unit, the method comprising the steps of:

providing power to the power transforming module through the input port;

transforming the power by the power transforming module to charge the capacitor unit and light at least a light emitting diode through the output port;

detecting whether the power transforming module receives the power from the power source; and releasing over 50% power stored in the capacitor unit in two seconds when the power transforming module does not receive the power from the power source.

19. The method as defined in claim 18, wherein the power stored in the capacitor unit is released by the resistor unit.

20. The method as defined in claim 18, further comprising the step of charging the capacitor unit when the power transforming module receives the power from the power source.

21. The method as defined in claim 18, wherein the power is detected between the input port and the DC/DC converter.

22. The method as defined in claim 18, wherein the power transforming module includes a DC/DC converter having an input side and an output side to receive the power via the input side, transform the power, and transmit the power out via the output side, and the power is detected at the input side of the DC/DC converter.

23. The method as defined in claim 18, wherein the power transforming module includes a DC/DC converter having an input side and an output side to receive the power via the input side, transform the power, and transmit the power out via the output side, and the power is detected at the output side of the DC/DC converter.

24. The method as defined in claim 18, wherein the power transforming module includes a DC/DC converter having an input side and an output side to receive the power via the input side, transform the power, and transmit the power out via the output side, and the power is detected between the input side and the output side of the DC/DC converter.

* * * * *